US008596167B2

(12) United States Patent
Bartz

(10) Patent No.: US 8,596,167 B2
(45) Date of Patent: Dec. 3, 2013

(54) BOTTLE CAP OPENER

(76) Inventor: Robert Bartz, Yakama, WA (US)

( * ) Notice: Subject to any disclaimer, the term of this patent is extended or adjusted under 35 U.S.C. 154(b) by 250 days.

(21) Appl. No.: 13/277,364

(22) Filed: Oct. 20, 2011

(65) Prior Publication Data

US 2013/0098210 A1 Apr. 25, 2013

(51) Int. Cl.
*B67B 7/18* (2006.01)
*B67B 7/14* (2006.01)

(52) U.S. Cl.
USPC ..... 81/3.4

(58) Field of Classification Search
USPC ..... 81/3.09, 3.4, 3.41
See application file for complete search history.

(56) References Cited

U.S. PATENT DOCUMENTS 1,752,189 A * 3/1930 Lotz ..... 81/3.27
2,589,693 A * 3/1952 Hess ..... 81/3.4
3,591,031 A * 7/1971 Komendowski ..... 215/250
D249,452 S * 9/1978 Gendron ..... D8/40
D273,555 S * 4/1984 Tanner ..... D8/40
4,718,312 A * 1/1988 Jones ..... 81/3.2
4,718,874 A * 1/1988 Warren ..... 446/36
D339,274 S * 9/1993 Alpers ..... D8/43
6,666,110 B1 * 12/2003 Buetner
D496,570 S * 9/2004 Wolf ..... D8/40
7,004,049 B2 * 2/2006 So et al. ..... 81/3.09
D517,881 S * 3/2006 Kelleghan ..... D8/38
D520,825 S * 5/2006 Kelleghan ..... D8/38
7,240,589 B2 * 7/2007 Kehoe ..... 81/3.09
D548,032 S * 8/2007 Hernandez, Jr. ..... D8/40
7,267,031 B1 * 9/2007 Burton et al. ..... 81/3.4
D589,589 S * 3/2009 McCloudry et al. ..... D8/19
8,079,152 B2 * 12/2011 Garman et al. ..... D8/33
D656,803 S * 4/2012 Carley ..... D8/33
2008/0072709 A1 * 3/2008 Dye ..... 81/3.09
2011/0119835 A1 * 5/2011 Bates et al. ..... 7/155
2013/0047317 A1 * 2/2013 Hanover et al. ..... 2/209.12

OTHER PUBLICATIONS

Fig. 1 attached hereto., date unknown, author unknown.

* cited by examiner

*Primary Examiner* — David B Thomas

(57) ABSTRACT

A twist-off cap bottle opener having a varying cap engaging radii.

4 Claims, 3 Drawing Sheets

BOTTLE CAP OPENER

CROSS-REFERENCES TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF INVENTION

This invention relates to a bottle openers and more specifically, to an opener for removing twist-off caps from a bottle. Twist-off caps are well known in the art. To remove a twist-off cap from a bottle the user, generally, grasps the cap between the thumb and a finger twisting it until it loosens.

FIG. 1 shows a twist-off cap bottle opener (10) that is known in the art. Generally, the twist-off cap bottle opener (10) is defined by a substantially circular body (11) which defines a hole. The twist-off cap bottle opener (10) has an inner surface (12) at the inner radius (r) and outer surface (13) at (r+x). The inner surface (12) defines a ratchet (14) which engages twist-off caps. In some instances, prior art twist-off cap bottle openers may have had a lever arm (15).

Flight attendants, and others in similar professions, open many twist-off cap bottles a day. Prior art twist-off cap bottle openers (10), described above, are lacking, however, because those engage a twist-off bottle cap of a defined radius.

BRIEF DESCRIPTION OF INVENTION

Accordingly, it is an objective of the present invention to provide a twist-off cap bottle opener which overcomes the disadvantages of the prior art bottle openers. Another objective of the present invention is to provide a lever that can help prevent/reduce the symptoms of Carpel Tunnel Syndrome or help those with arthritis or other similar disabilities easily opener a twist-off cap.

BRIEF DESCRIPTION OF THE SEVERAL VIEWS OF THE DRAWINGS

Other features and advantages of the present invention will become apparent in the following detailed descriptions of the preferred embodiment with reference to the accompanying drawings, of which.

DETAILED DESCRIPTION OF THE INVENTION

Figure 1:
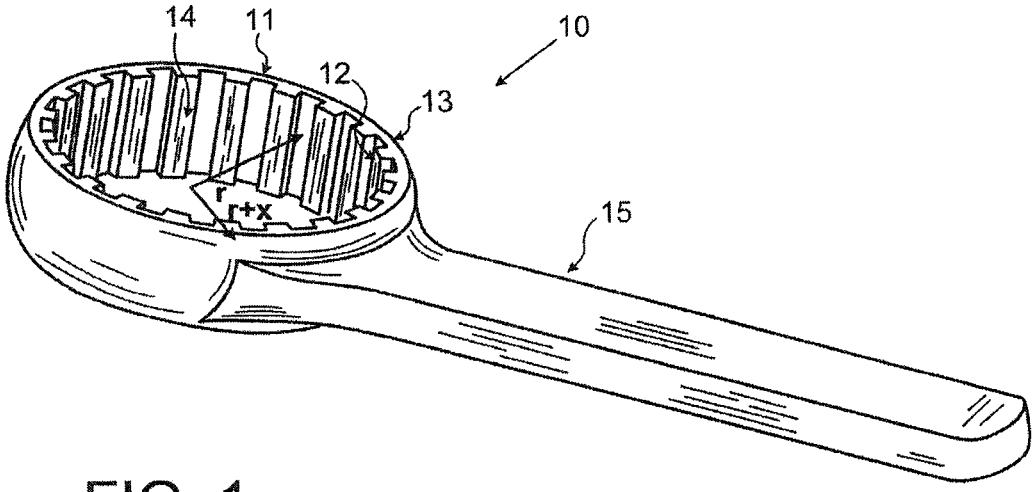
FIG. 1 (PRIOR ART)
FIG. 1 is a perspective view showing a prior art twist-off cap bottle opener.
Figure 2:
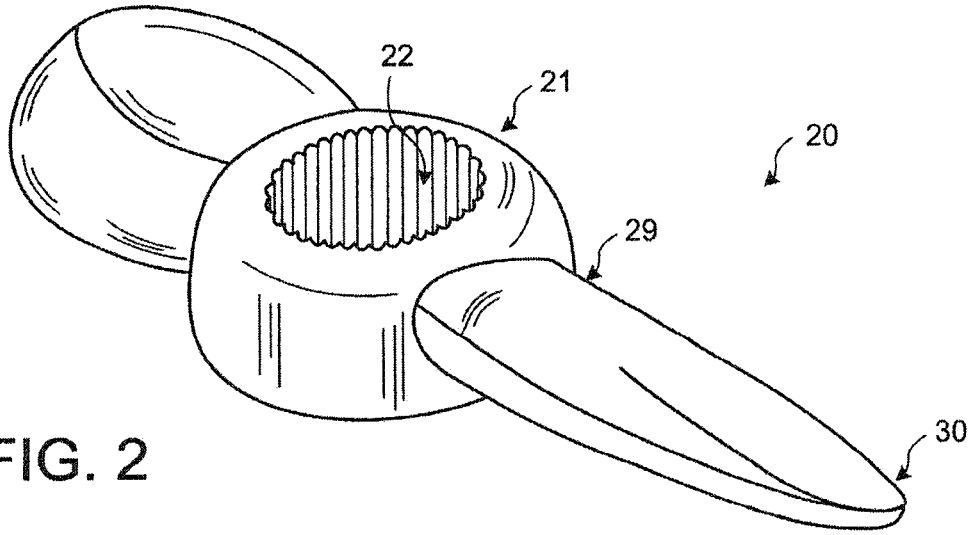
FIG. 2 is a perspective view of an embodiment of the invention described herein.
Figure 3:
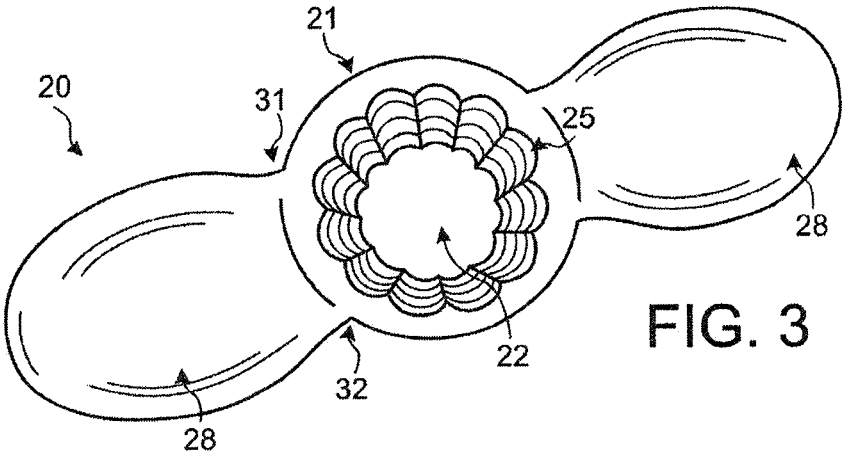
FIG. 3 is a top view of an embodiment of the invention described herein.
Figure 4:
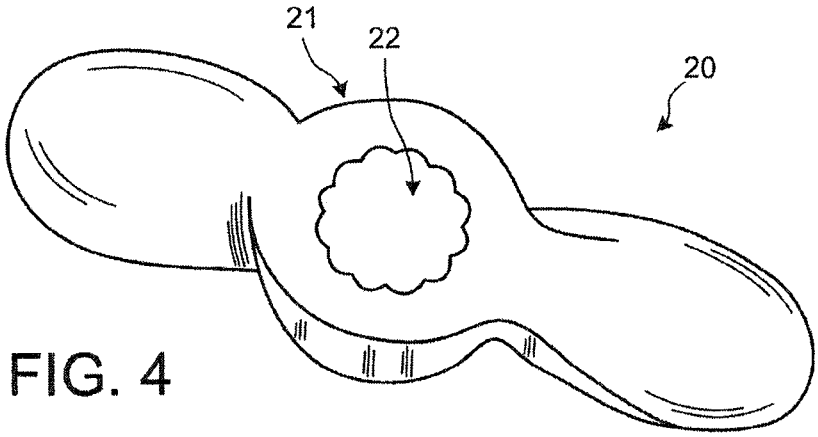
FIG. 4 is a bottom view of an embodiment of the invention described herein.
Figure 5:
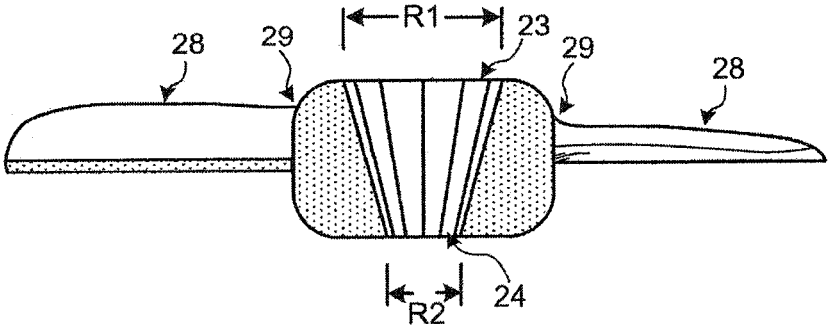
FIG. 5 is a sectional side view of an embodiment of the invention described herein.
Figure 6:
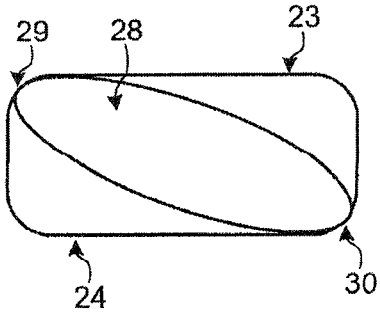
FIG. 6 is an end view of an embodiment of the invention described herein.

The present invention is described more fully hereinafter with reference to the accompanying drawings, in which preferred embodiments of the invention are shown. This invention may, however, may be embodied in many different forms and should not be construed as limited to the embodiments set for herein; rather, these embodiments are provided so that this disclosure will be thorough and complete and will fully convey the scope of the invention to those skilled in the art.

Referring now to the drawings, FIGS. 2 through 5, shows a twist-off cap bottle opener or bottle opener (20). Generally, the bottle opener (20) is defined by a substantially circular body (21) which defines a hole (22). The bottle opener (20) has a bottom (24) and a top (23). The hole (22) has a radius of R1 at the top (23) and a radius of R2 at the bottom (24) where R1≠R2 and R2<R1. The surface R1, R2 defines a ratchet (25) for engaging a twist-off bottle cap. The varying radii allow the bottle opener (20) to engage twist-off bottle caps of various sizes.

In one preferred embodiment, the substantially circular body (21) comprises at least one set of blades (28). A blade (28) comprises a near end (29) and a distal end (30). The near end is attached to the substantially circular body (21). A blade (28) further comprises a width (31, 32). The blade (28) at (31) is attached to the top (23) of the substantially circular body (21); the blade (28) at (32) is attached to the bottom (24) of the substantially circular body (21).

Figure 7:
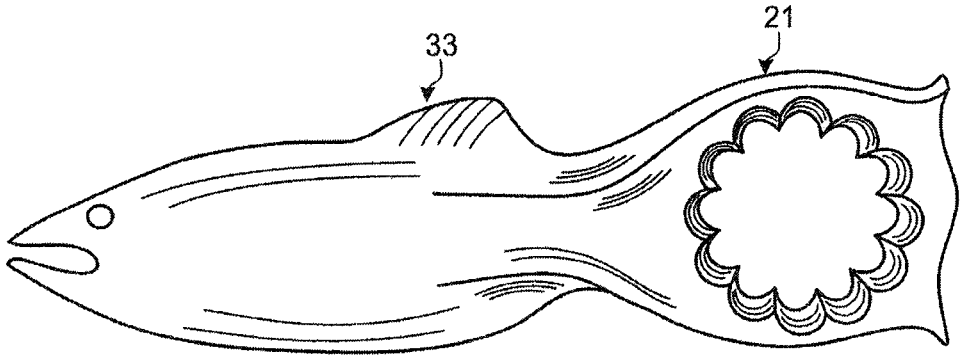
FIG. 7 is a top view of another embodiment of the invention described herein.

In another embodiment, as shown in FIG. 7, the substantially circular body (21) further comprises a lever arm (33). In the drawing shown, the lever arm (33) is shaped as a fish. However, the lever arm may take on any shape.

What is claimed is:

1. A twist-off cap bottle opener comprising:

a substantially circular body which defines a hole;

the substantially circular body has a bottom side and a top side;

the hole has a radius of R1 at the top side and a radius of R2 at the bottom side;

where R1≠R2 and R2<R1;

wherein a surface at R1,R2 defines a ratchet comprised of scallop shaped grooves for engaging a twist-off cap.

2. The twist-off cap bottle opener of claim 1, where the substantially circular body further comprises at least one set of opposing blades, where a blade comprises a near end and a distal end, where the near end is attached to an outer periphery of the substantially circular body.

3. The twist-off cap bottle opener of claim 2, where the blade further comprises a width (x,x+y); where the blade at (x) is attached to the top side of the substantially circular body; and, where the blade at (x+y) is attached to the bottom side of the substantially circular body.

4. The twist-off cap bottle opener of claim 1 where the substantially circular body further comprises a lever arm.

* * * * *